United States Patent [19]

Munk et al.

[11] 4,094,614

[45] June 13, 1978

[54] PROPELLER

[75] Inventors: Torben Munk, Virum; Nils Oluf Ehrenskjöld, Kolding, both of Denmark

[73] Assignee: Gori-Vaerk A/S, Kolding, Denmark

[21] Appl. No.: 633,417

[22] Filed: Nov. 19, 1975

[30] Foreign Application Priority Data

Nov. 20, 1974 Denmark ..... 6023/74

[51] Int. Cl.[2] ..... B63H 1/20

[52] U.S. Cl. ..... 416/140; 416/142

[58] Field of Search ..... 416/140, 142, 143

[56] References Cited

U.S. PATENT DOCUMENTS

| | | | |
|---|---|---|---|
| 725,097 | 4/1903 | Learnard | 416/87 X |
| 731,020 | 6/1903 | Charles | 416/142 |
| 938,290 | 10/1909 | Thompson | 416/139 X |
| 1,491,997 | 4/1924 | Messick | 416/131 |
| 1,682,893 | 9/1928 | Cierva | 416/140 A |
| 1,862,481 | 6/1932 | Glenwright | 416/140 |
| 2,481,751 | 9/1949 | James | 416/142 |
| 2,500,382 | 3/1950 | Rowley | 416/142 |
| 2,608,257 | 8/1952 | Godfrey | 416/142 |
| 3,187,820 | 6/1965 | Maloof | 416/140 |
| 3,981,613 | 9/1976 | Ehrenskjold et al. | 416/142 |

FOREIGN PATENT DOCUMENTS

| | | | |
|---|---|---|---|
| 768,964 | 8/1934 | France | 416/142 |
| 2,050,420 | 4/1972 | Germany | 416/142 |
| 18,344 of | 1909 | United Kingdom | 416/142 |

*Primary Examiner*—Everette A. Powell, Jr.
*Attorney, Agent, or Firm*—Fleit & Jacobson

[57] ABSTRACT

A propeller such as a ship's propeller or screw comprises at least one propeller blade, and a propeller drive shaft. The propeller blade is mounted on the propeller drive shaft by employing a hub having a free end secured on the propeller drive shaft. The hub is provided with a central bore in the free end thereof. A pivot axis is defined mounted within the hub and perpendicular to the axis of the drive shaft. The pivot axis comprises a pivot shaft.

The blade is pivotally mounted about the inner end of the blade freely about the pivot shaft, the pivot shaft intersecting the longitudinal direction of the blade. Abutment means for the blade are provided for limiting the free pivotal movement of the blade between two extreme positions at either side of the position in which the propeller blade extends substantially perpendicular to the axis of the shaft. The abutment means comprises a pair of abutment members secured in the bore to serve as abutments for the blades. The abutment members can be adjusted by a clasp nut mounted within the central bore. The abutment members are removably secured to the clasp nut, and has an abutment face for limiting the free pivotal movement of the blade.

2 Claims, 5 Drawing Figures

PROPELLER

Figure 1:
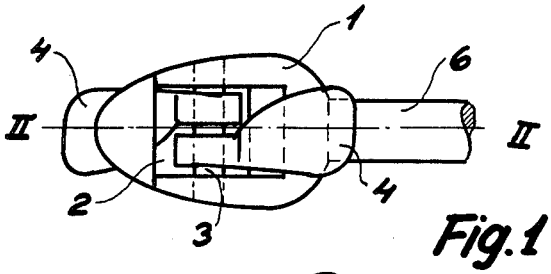

This invention relates to a propeller such as a ship's propeller or screw and comprises one or more propeller blades which are mounted on the propeller shaft or in a hub secured thereto to be pivotable about an axis substantially perpendicular to the shaft axis. Motordriven vessels and boats are often provided with propellers or screws the blades of which are either rigid in relation to the propeller shaft or mounted rotatably about their longitudinal direction for adjustment to varying operating conditions. The known art also comprises propellers intended particularly for motor sailing vessels or sailing boats with auxiliary engine and having blades which are pivotally suspended so that they can be folded against each other in the longitudinal direction of the propeller shaft when the propeller is not rotating and yield a minimum of resistance when the boat is under sail.

Propellers of either of the said types are used for other purposes as well, such as for instance transport of air, fluidization or transport of finely divided material, transport of granulate or grain, and for other forms of propulsion.

From the propellers of the prior art it is known that the blades can adjust themselves automatically to various positions corresponding to varying operating conditions, but such propellers are suitable only for boats which are occasionally navigated solely by sails and they require a relatively large space in the longitudinal direction of the propeller shaft.

It is the object of the present invention to provide a propeller which enables the automatic adjustment of the blades mentioned in connection with the folding propellers, but which at the same time is of a substantially simpler construction than the said propellers with rotatable propeller blades and requires less space than folding propellers. Such a propeller will be suitable for many purposes and can for instance be used with great advantage in motorboats because the propeller under all operating conditions, also during reverse navigation, will adjust itself to optimum yield.

This object has been accomplished by providing for each propeller blade an abutment to limit the pivotal movement of the blade between two extreme positions of which at least one is disposed so as to permit the blade to pivot outwardly of the position in which the propeller blade extends substantially perpendicular with respect to the shaft axis.

As a result of the combined effect of the centrifugal force during rotation and the axial force produced by the surrounding medium the blades of such a propeller will adjust themselves in an expedient position deviating from the position perpendicular to the propeller shaft, and the shape of the blades may be adapted to that position. Where the propeller is used in a motorboat the blades will assume a forwardly inclined position during forward navigation and a rearwardly inclined position during reverse navigation. It is therefore possible to adapt the shape and length of the blades to obtain substantially the same efficiency during forward and reverse navigation. The whole arrangement requires relatively limited space in the longitudinal direction of the boat, which is highly desirable. The construction is extremely simple, as will be shown by the following description and the drawing.

The simplicity of the construction is due inter alia to the fact that the two propeller blades, though they can be coupled together, may also be mounted separately, for instance on a common shaft without being in any way coupled together, for the position of the blades during standstill is immaterial, and both or all of the blades will automatically and rapidly assume the proper position during navigation. But the blades may also be mounted on respective oscillation axles and may be coupled together.

According to the invention it will further be expedient that at least one of the said abutments is adapted for variation of the extreme position or positions, so that the swing of the propeller blades can be adjusted to all the factors of significance for attaining the most efficient operation, viz. the effectiveness of the motor that drives the propeller, the shape of the vessel and the positioning of the propeller. Where the propeller is used in vessels, as well as for all other uses of such a propeller, it will also be necessary to take account of the physical properties of the medium in which the propeller is to operate. The said variation of the positions of the abutment or abutments may be provided in many expedient ways, but according to the invention it will be particularly expedient to mount the blades in a hub with a central bore in the free end of the hub and to secure the abutment member in that bore. Thus the abutments can be adapted to readily exchangeable and it will be possible to have different abutments to provide different swing of the propeller blades.

It will often be sufficient to be able to adjust the swing rearwardly, but where it is desired to be able to adjust the abutment positions for both rearward and forward oscillation of the propeller blades it will be expedient for the said abutment member to comprise an externally threaded plug which is screwed into an internal thread in the central bore and is provided with an axial bore in which a coupling rod is displaceably mounted to support on either side of the plug an adjustable abutment, the said coupling rod having an extension formed as a rack for cooperation with toothed sectors of the propeller blades disposed coaxially with the oscillation axes of the blades. Thus it will be possible to adjust the distance between the two abutments and simultaneously displace them so that the extreme positions of the two abutments are completely under control.

Figure 2:
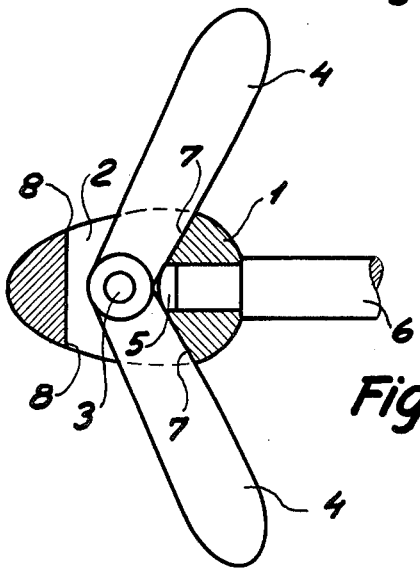
Figure 3:
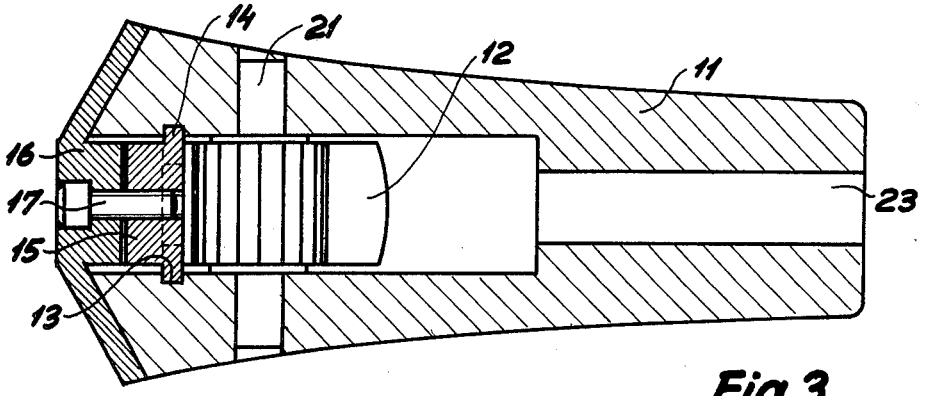
Figure 4:
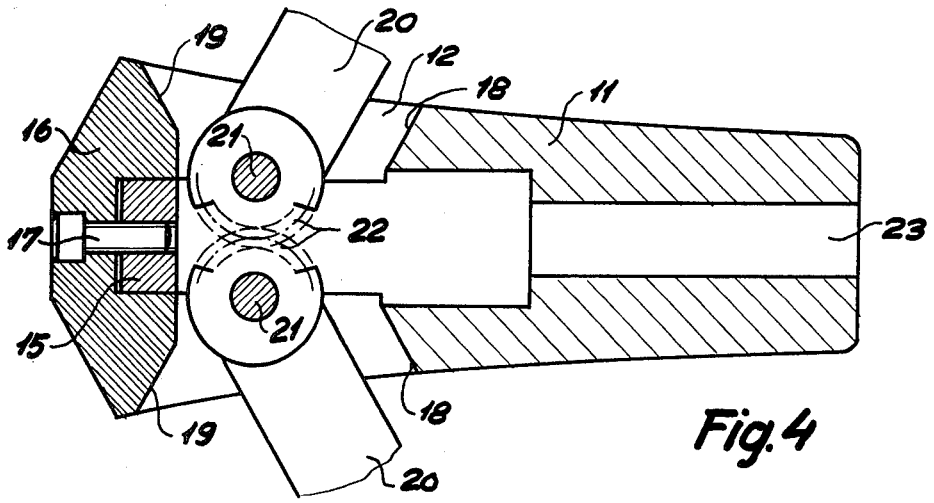
Figure 5:
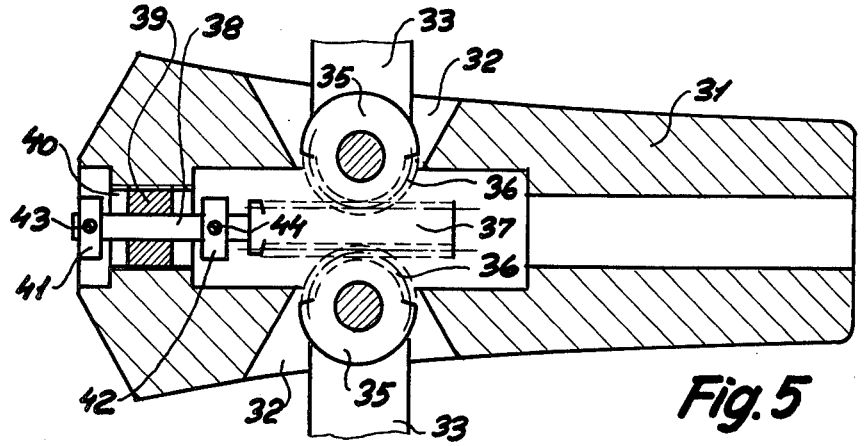

The invention will be described in greater detail below with reference to the drawings, in which FIG. 1 presents a propeller according to the invention viewed in side elevation, FIG. 2 is a section along the line II—II in FIG. 1, FIGS. 3 and 4 show two axial sections perpendicular to one another through a second embodiment of a propeller according to the invention, and FIG. 5 presents an axial section of a specific embodiment of adjustable abutments.

FIGS. 1 and 2 show an embodiment of a propeller according to the invention comprising a hub 1 with a transverse opening 2, opposite which is mounted a shaft 3 on which two propeller blades 4 are pivotally mounted. The hub 1 has a central bore 5 in which the driving shaft 6 is introduced and secured. The transverse recess 2 is formed to provide for each of the propeller blades 4 two abutments 7 and 8 which limit the oscillation of the propeller blades sideways, but within this region of movement the propellers may at any time adjust themselves to the most effective utilization of the motor power in accordance with the rotary speed and the axial pressure produced by the surrounding medium.

The embodiment shown in FIG. 3 likewise comprises a hub 11 with a recess 12 extending right to the rear end of the hub, which is further provided with a peripheral groove 13 for receiving a flange 14 on a clasp nut 15. At the end of the hub is provided an abutment member 16 which is retained against the clasp nut 15 by means of a screw 17 and which serves as abutment for the propeller to limit its oscillation movement rearwards. This abutment may be exchanged with a second abutment of a slightly different shape so that abutment occurs at a different stage of the oscillating movement of the propeller. At the end of the recess 12 there is a second abutment 18 whereby a limitation of oscillation is obtained in the same way as in the embodiment illustrated in FIGS. 1 and 2, only the front abutment face marked 19 being adjustable.

In this embodiment the two blades 20 are mounted on respective shafts 21 and provided with respective toothed sectors 22 which are interengaged so that the movements of the two propeller blades will always be identical. At the opposite end the hub has a central bore 23 adapted to receive and secure the driving shaft.

FIG. 5 shows a specific embodiment which, like the others, comprises a hub 31 with a transverse opening 32 through which two propeller blades 33 project. The two blades are mounted pivotally on respective shafts and their hub members 35 are provided with respective toothed sectors 36 which cooperate with a rack 37. The rack 37 is an extension of a coupling rod 38 which is mounted displaceably in the axial bore in a plug 39 which by means of an external thread is screwed into the internal thread of an axial bore 40 in the hub 31. On either side of the plug 39 is provided an abutment 41 and 42 which are clamped on the coupling rod by means of locking screws 43 and 44.

When the propeller blades 33 are moved by the action of the centrifugal force and the axial pressure produced by the surrounding medium the movement of the blades will cause displacement of the coupling rod and the two abutments 41 and 42 will limit that movement as might be desirable with a view to the structure of the boat or to the external conditions to which any propeller for any purposes will be subjected, and because the abutments can be displaced and the plug 39 can be screwed forward and backward, it will be possible to adapt the limitation of the propeller blade movements entirely as desired.

What we claim is:

1. A propeller such as a ship's propeller or screw and comprising at least one propeller blade, a propeller drive shaft, means for mounting said propeller blade on the propeller drive shaft comprising a hub having a free end secured on the propeller drive shaft, said hub being provided with a central bore in the free end thereof, means defining a pivot axis mounted within said hub and perpendicular to the axis of the drive shaft comprising a pivot shaft, means pivotally mounting said blade about the inner end of the blade freely about the pivot shaft, said pivot shaft intersecting the longitudinal direction of the blade, abutment means for the blade for limiting the free pivotal movement of the blade between two extreme positions at either side of the position in which the propeller blade extends substantially perpendicular to the axis of the shaft, said abutment means comprising a pair of abutment members, said abutment members being secured in said bore to serve as abutments for the blades, and means for adjusting one of said abutment members comprising a clasp nut mounted within said central bore, securing means for removably securing one of said abutment members to said clasp nut, said abutment member secured to said clasp nut having an abutment face for limiting the free pivotal movement of the blade.

2. A propeller according to claim 1 comprising a pair of propeller blades, said means defining a pivot axis comprising a pair of pivot shafts parallel to each other and perpendicular to the axis of the propeller drive shaft, each of said propeller blades having a toothed sector, each of said toothed sectors interengaging with each other so that the movement of the propeller blades will be equal.

* * * * *